US005833094A

United States Patent [19]

Willis

[11] Patent Number: 5,833,094

[45] Date of Patent: Nov. 10, 1998

[54] HANGABLE GAS CAN

[76] Inventor: Jody L. Willis, 1612 Williams Rd., Plant City, Fla. 33565

[21] Appl. No.: 789,825

[22] Filed: Jan. 28, 1997

[51] Int. Cl.[6] ..... B67D 5/06

[52] U.S. Cl. ..... 222/180; 222/211; 222/530

[58] Field of Search ..... 222/173, 180, 222/181.2, 181.3, 189.1, 212, 210, 482, 529, 530, 211; 248/311.2

[56] References Cited

U.S. PATENT DOCUMENTS

| | | | |
|---|---|---|---|
| D. 289,976 | 5/1987 | Humphries . | |
| D. 305,981 | 2/1990 | Levee . | |
| D. 339,022 | 9/1993 | McGinnis . | |
| D. 356,951 | 4/1995 | Mitchell . | |
| 3,170,601 | 2/1965 | Daley . | |
| 4,121,800 | 10/1978 | McClellan | 248/311.2 |
| 4,650,100 | 3/1987 | Echazabal . | |
| 4,854,486 | 8/1989 | Daley . | |
| 4,911,334 | 3/1990 | Kedzierski . | |
| 4,923,098 | 5/1990 | Schoonover et al. | 222/465.1 |
| 4,972,972 | 11/1990 | Goguen | 222/529 |
| 5,295,610 | 3/1994 | Levison | 222/482 |
| 5,332,127 | 7/1994 | White . | |
| 5,409,135 | 4/1995 | Campau . | |
| 5,597,097 | 1/1997 | Morris | 222/529 |
| 5,598,955 | 2/1997 | Reilley | 222/529 |

*Primary Examiner*—Philippe Derakshani
*Attorney, Agent, or Firm*—Stein, Schifino & Van Der Wall

[57] ABSTRACT

A hangable liquid containing apparatus for dispensing a liquid such as gasoline. The apparatus comprises a container adapted to hold the liquid, hanging means for hanging and supporting the container formed from the flexible side walls of the container, an elongated nozzle assembly comprising of a hose and nozzle, and a vent positioned in the container. The container of the apparatus is to be hung above the ground and out of the way of the hazards typically associated with storing and dispensing liquids such as combustion. The hose is primed with gasoline by pressing on the side of the container and then the apparatus uses gravity to dispense the fuel from the nozzle. Moreover, the apparatus utilizes the side of a wall to provide additional support and stability while being hung up away from the ground.

13 Claims, 2 Drawing Sheets

HANGABLE GAS CAN

BACKGROUND OF THE INVENTION

1. Field of the Invention

The present invention relates to a container for storing and dispensing of a liquid. This invention more particularly pertains to a container adapted to hold and dispense gasoline that may be hung from a support.

2. Description of the Background Art

Presently, most commercially available gas cans are cumbersome and present worrisome storage problems. For example, gasoline cans specifically for dispensing gasoline to household machines such as lawn movers and generators are generally one gallon to five gallon containers that are typically stored on the ground or upon a shelf but which may be transported to various alternative locations. These portable gas cans present significant risks to their owners because of the possibility of exposing gasoline to multiple hazards such as sparks, flames or extreme heat as a result of their movable nature.

Moreover, since these common gas containers are portable, they are to be lifted by the user in order to dispense fuel into the desired fuel tank of the machine to be operated. In other words, these common gas cans are difficult to use because of the difficulty in dispensing fuel as a result of repeatedly placing a strain upon the back of the user. Furthermore, the larger the gas requirement of the machine to be fueled and operated, the larger the required portable gas can. Otherwise, multiple refuelings are required because of the smaller size characteristics of these known gas cans.

Included in some of the prior art is recognition that a problem exists with the storage and maintenance of containers containing flammable liquids and, therefore, it is often desirable to dispense gasoline from an out of the way location where the gasoline is not likely to ignite. However, none of the prior art known to the inventor discloses a hangable gas can as taught by the present invention. In response to the realized inadequacies of these earlier gas cans, it became clear that there is a need for a more sophisticated container for dispensing fuel out of the way of sparks or flames. Moreover, this device must provide for simplified use in which the user does not have to repeatedly lift the gas can which is weighted down with fuel. Also, in as much as the art consists of various types of gasoline containers, it can be appreciated that there is a continuing need for and interest in improvements to the storage and dispensing of gasoline, and in this respect, the present invention addresses these needs and interests.

Therefore, the principal object of this invention is to provide an improvement which overcomes the aforementioned inadequacies of the prior art devices and provides an improvement which is a significant contribution to the advancement of the gasoline storage and dispensing art.

Another object of this invention is to provide a new and improved hangable gas can which has all the advantages and none of the disadvantages of the earlier gas cans.

Still another objective of the present invention is to provide a specifically structured gas container to eliminate the necessity of repeated lifting of the gas can.

Yet another objective of the present invention is to provide a container for the storage and dispensing of gasoline is a safe and efficient manner.

Still a further objective of the present invention is to provide a liquid containing apparatus for dispensing a liquid, the liquid containing apparatus hangable from a vertical support such that the liquid containing apparatus has a vertical height relative to the ground, the liquid containing apparatus comprising, in combination: a container adapted to hold the liquid, thereby defining a liquid level within the container, the container comprising a plurality of flexible side walls and an outlet, one of the plurality of flexible side walls being horizontally supported by the vertical support, the outlet having a vertical height relative to the liquid level; hanging means for hanging and supporting the container in an elevated position, the hanging means formed from at least one of the flexible side walls of the container and configured such that an opening is formed therethrough; an elongated nozzle assembly with a flow control valve positioned therein, the nozzle assembly in liquid communication with the outlet of the container for dispensing the liquid therefrom; and a vent positioned in the container, the vent having a vertical height relative to the liquid level sufficient to provide a predetermined flow of liquid through the nozzle assembly.

Yet a further objective is to provide a liquid containing apparatus for dispensing a liquid, the liquid containing apparatus hangable from a vertical support such that the liquid containing apparatus has a vertical height relative to the ground, the liquid containing apparatus comprising, in combination: a container adapted to hold the liquid, thereby defining a liquid level within the container, the container comprising a plurality of flexible side walls and an outlet, the outlet having a vertical height relative to the liquid level, the plurality of flexible side walls disposed in a spaced relation to one another and extend upward from a base to a top of the container, one of the flexible side walls forming a front wall and another of the flexible side walls forming a rear wall oppositely disposed from the front wall at the base of the container, the rear wall being horizontally supported by the vertical support, and the front and rear walls of the plurality of flexible side walls have a transverse dimension substantially greater than the transverse dimension of the other of the plurality of flexible side walls; hanging means for hanging and supporting the container in an elevated position, the hanging means integrally formed from the front and rear walls extending upward to form the hanger means above the top of the container and configured such that an opening is formed therethrough; a hook for receiving the hanging means, the hook passing through the opening and the container being supported thereon; an elongated nozzle assembly with a flow control valve therein, the nozzle assembly in liquid communication with the outlet of the container for dispensing the liquid therefrom, the nozzle assembly comprising a hose and a nozzle, the flow control valve being positioned within the nozzle, the flow control valve having both open and closed positions for controlling liquid flow through the nozzle, the nozzle in fluid communication with a first end of the hose and the hose in fluid communication with the outlet of the container and having a second end positioned in the container below the liquid level; and a vent positioned in the container, the vent having a vertical height relative to the liquid level sufficient to provide a predetermined flow of liquid through the nozzle assembly.

The foregoing has outlined some of the pertinent objects of the invention. These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. The present invention is directed to an apparatus that satisfies this need for a permanently out of the way and safe storage container for the dispensing of gasoline. For the purpose of summarizing the invention, the liquid containing apparatus for dispensing a liquid such as gasoline is hangable from a vertical support such as a wall such that the container or gas can has a vertical height relative to the ground. The invention comprises a container of flexible side walls, nozzle assembly with a flow control valve, a vent in the container providing sufficient flow of gasoline through the nozzle assembly, and a hanging means on the container for hanging and supporting the container of gasoline upon the side of a wall or other vertical support structure.

The nozzle assembly of the present invention comprises a hose and a nozzle. The flow control valve is positioned within the nozzle and has a open position for allowing the liquid to flow through the nozzle and a closed position for blocking the flow of the liquid through the nozzle. The nozzle is in fluid communication with the first end of the hose and the hose is in fluid communication with the outlet of the container. The second end of the hose is positioned in the container below the liquid level. A filter may be coupled to this second end of the hose inside the container.

One of the plurality of flexible side walls or the rear wall of the container is horizontally supported by the vertical support or the wall. In other words, a filled gas can that is hanging off the ground from its hanger leans back up against the wall from which its hanging from.

An important feature of the present invention is that the gas can is hanging and being supported out of the way of sparks, flames or other hazards by a vertical support such as a wall of a garage or other structure. Also, the height of the gas can is necessary in order to utilize gravity in dispensing the fuel. Another important feature is that the sides of the container are flexible. The flexible sides allow the user to prime the hose with liquid by pressing on the container and then releasing it. This in and out motion allows the liquid to enter the nozzle assembly in order to be pumped. Therefore, it can be readily seen that the present invention provides a means to dispense and store liquids such as gasoline in a safe but usable manner. Thus, a hangable gas can such as the present invention would be greatly appreciated.

The foregoing has outlined rather broadly, the more pertinent and important features of the present invention. The detailed description of the invention that follows is offered so that the present contribution to the art can be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more succinct understanding of the nature and objects of the present invention, reference should be directed to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
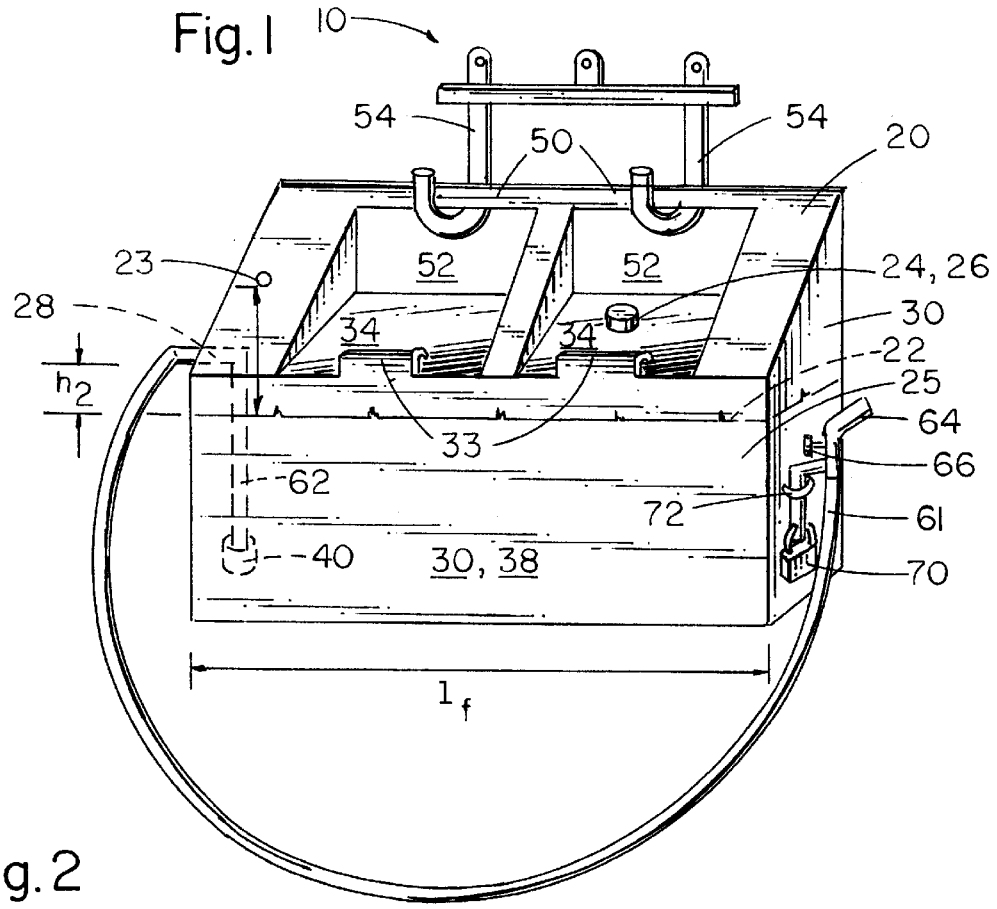
FIG. 1 is an illustration of the preferred embodiment of the hangable liquid containing apparatus in accordance with the principles of the present invention.
Figure 2:
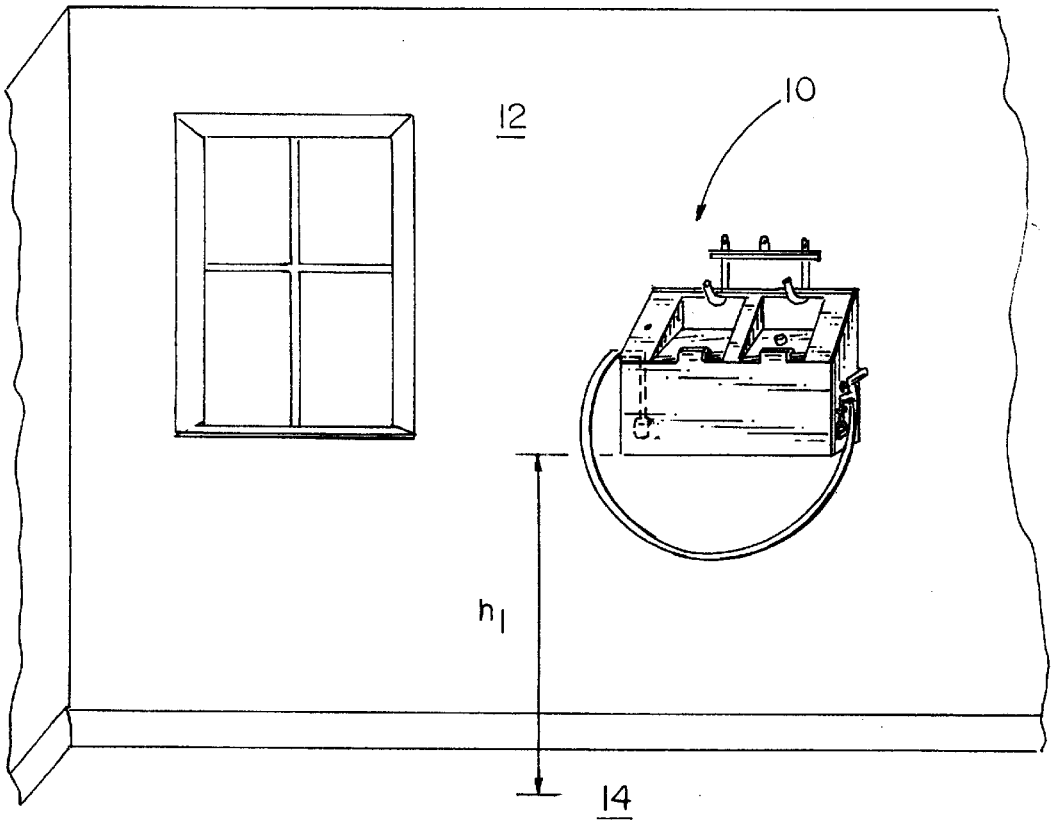
FIG. 2 is an illustration of the preferred embodiment of the present invention hanging upon the side of a wall.

With reference to the drawings, and in particular to FIG. 1 thereof, a new and improved liquid containing apparatus embodying the principles and concepts of the present invention and generally designated by the reference number 10 will be described. As shown in FIG. 2, the liquid containing apparatus 10 is hangable from a vertical support 12, such as the wall 12 shown, such that the liquid containing apparatus 10 has a vertical height $h_1$ relative to the ground 14.

In the preferred embodiment, the liquid containing apparatus 10 is a hangable gas can 10 used for storing and dispensing gasoline 25. Also, it is preferable that the container 20 be a ten gallon container 20 because a smaller container would otherwise require refilling to frequently. Moreover, a container substantially larger than ten gallons creates storage and compatibility problems for the typical user because of the larger capacity.

Figure 3:
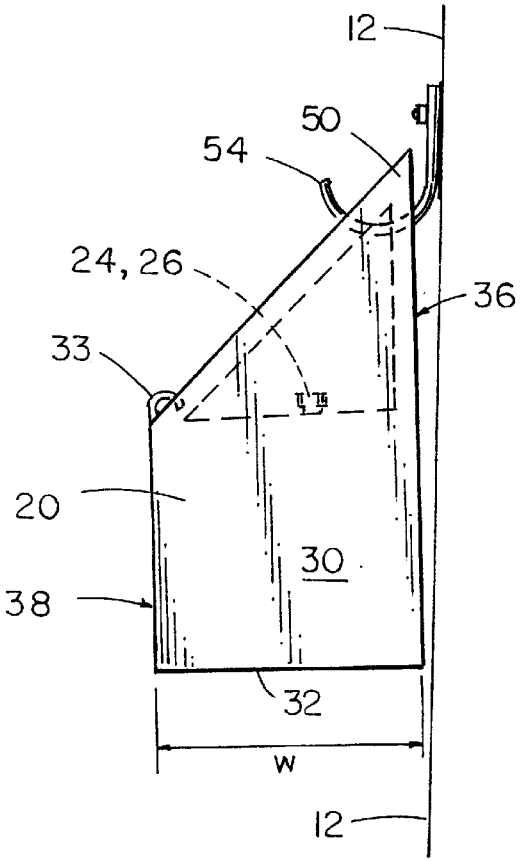
FIG. 3 is a side view of the preferred embodiment of the present invention.
Figure 4:
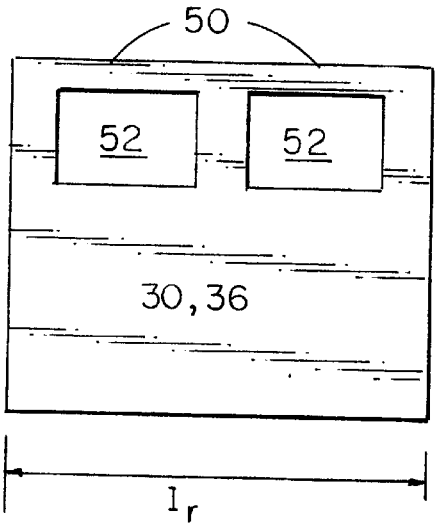
FIG. 4 is a rear view of the preferred embodiment of the present invention.

As shown in FIG. 1, the hangable gas can 10 comprises a container 20 adapted to hold the liquid or gasoline 23 thereby defining a liquid level 22 within the container 20. The container 20 of the present invention comprises a plurality of flexible side walls 30 and an outlet 28 preferably in one of those flexible side walls 30. One of the plurality of flexible side walls 30 is horizontally supported by the vertical support 12 as shown in FIG. 4. The vertical support or wall 12 as shown in FIG. 3 helps stabilize the filled container 20 while it is being hung and supported off the ground 14.

Also, rather than having the outlet 28 on the rear wall 36 or front wall 38 of the plurality of flexible side walls 30, it is preferable to have the outlet 28 on one of the remaining sides 30 of the container 20. The outlet 28 should have a vertical height $h_2$ relative to the liquid level 22 as shown in FIG. 1.

The liquid containing apparatus or gas can 10 also comprises a hanger 50 for hanging and supporting the container 20. The hanger 50 is formed from at least one of the flexible side walls 30 of the container 20 and is configured such that an opening 52 in formed therethrough as best shown in FIGS. 1 and 4.

The plurality of flexible side walls 30 are disposed in a spaced relationship to one another and extend upward from a base 32 to a top 34 of the container 20. One of the plurality of flexible side walls 30 forms a front wall 38 and another of the flexible side walls forms a rear wall 36 oppositely disposed from the front wall 38 at the base 32 of the container 20. The front and rear walls 38 and 36 extend upward to form the hanger 50 above the top 34 of the container 20. Preferably, the rear wall 36 is horizontally supported by the vertical support 12. Also, the front and rear walls 38 and 36 of the plurality of flexible side walls 30 have a transverse dimension $1_f$ and $1_r$ respectively as shown in FIGS. 1 and 4 which are each substantially greater than the transverse dimension w shown in FIG. 3 of the other of the plurality of flexible side walls 30.

The liquid containing apparatus or gas can 10 also comprises an elongated nozzle assembly 60, 64. The nozzle assembly is in liquid communication with the outlet 28 of the container 20 for dispensing the liquid or gasoline 25 therefrom. Also, the liquid containing apparatus or gas can 10 comprises a vent 23 positioned in the container 20 as shown in FIG. 1. The vent 23 has a vertical height $h_3$ relative to the liquid level 22 sufficient to provide a predetermined flow of liquid or gasoline 25 through the nozzle assembly 60, 64.

The elongated nozzle assembly of the present invention comprises a hose 60 and a nozzle 64. The flow control valve 66 is positioned within the nozzle 64 and has both open and closed positions for controlling the liquid flow through the nozzle 64. The nozzle 64 is in fluid communication with the first end 61 of the hose 60 and the hose 60 is in fluid communication with the outlet 28 of the container 20. The hose 60 also has a second end 62 positioned in the container 20 below the liquid level 22.

The present invention may also further comprise a liquid intake port 24 positioned in the top 34 of the container 20 as shown in FIG. 1. The liquid intake port 24 is to be in fluid communication with the liquid in the container 20. It is preferred that the liquid intake port 24 be capped by a one-way airflow cap 26 coupled to the liquid intake port 24. The one-way airflow cap 26 allows air to flow into the container 20. Moreover, the present invention may further comprise gasoline 25 contained within the container 20.

The present invention may further comprise a hook 54 as shown in FIGS. 1 and 3 for receiving the hanger 50. The hook 54 passes through the opening 52 and the container 20 is then supported thereon. After ensuring that the area selected will support a filled container 20, fasten a hook 54 into the vertical support 12 preferably at a minimum height of 72 inches above the ground 14. The hook is preferably permanently mounted into a vertical support such as a concrete block wall with masonry screws or other similar connecting fasteners available for securing hooks 54 into wood or metal studs of frame walls.

The elongated nozzle assembly 60, 64 may be secured while not in use by a pair of hose hanger hooks 33 as shown in FIG. 1. The hose 60 may be hooked by the hose hanger hooks 33 and, therefore, be kept off the ground 14 and in a secure manner. The nozzle 64 may then be secured with the aid of a nozzle holder ring 72 protruding from one of the sides 30 of the container 20 as shown in FIG. 1. Moreover, access to the container 20 which may be filled with a liquid or gasoline 25 may be controlled through the use of a lock 70. A lever of a nozzle 64 may be placed through the nozzle holder ring 72 and the lock 70 may then be secured to the lever which prevents the nozzle 64 from being removed from the nozzle holder ring 72.

In order to begin refueling from the liquid containing apparatus or hangable gas can 10, remove the nozzle assembly 60, 64 from the container 20. The nozzle 64 should be in the open position when desiring the liquid to flow from the container 20. To begin refueling, push slightly against the flexible side wall 30 of the container 20 and release. Repeat this in and out motion until fuel begins to pour freely from out of the nozzle 64 and into the fuel tank or receptacle of the object to be filled. Once the flow of liquid or fuel is started, loosen the air vent 23 for a better flow of liquid or fuel. Also, loosen the vent 23 when the container 20 is exposed to direct sun light or when heat may expand the contents of the container 20. At this point, the hose 60 is primed and the liquid will now flow from the container 20 automatically. However, raising the hose 60 above the liquid level 22 while the flow control valve 66 is in the open position may unprime the hose 60. Thus, it may be necessary to prime the liquid containing apparatus 10 again.

When refilling of the container 20 is required, unhook the nozzle 64 from the nozzle holder ring 72 and raise the entire nozzle 64 and hose 60 above the container 20. While holding the hose 60 and nozzle 64 above the container 20, ensure that the nozzle 64 is pointed upward and is higher than the hose 60. If the hose 60 is allowed to be higher than the nozzle 64, liquid may be allowed to run out of the nozzle 64 and a spill will result. The flow control valve 66 should then be put into the open position so that the contents of the hose are allowed to run backwards into the container 20. When the hose 60 is completely empty, the flow control valve 66 may be returned to the closed position. The hose 60 may now be hooked by the hose hanger hooks 33 and the nozzle 64 may be placed into the nozzle holder ring 72. Before removing the container 20 from the hook 54, tighten the vent 23 in preparation of transportation the container 20. Now the container 20 may be transported to a filling station or other locations such that it may be refilled. The container 20 may be refilled by removing the one-way airflow cap 26 from the liquid intake port 24 and filling the container 20 to the maximum level which may be marked on the side of the container 20. Once refilling is complete, refasten the cap 26 to the intake port 24. The container 20 now may be transported and hung back on the hook 54. After hanging the liquid containing apparatus 10, it is necessary to again reprime the elongated nozzle assembly 60, 64 as described earlier.

The previously described embodiments of the present invention have many advantages, including allowing the user to forego the repeatedly lifting of a filled container which is weighted down with liquid. Moreover, the container of the present invention is mounted out of the way of the hazards typically associated with the storing and dispensing of fuel and, therefore, prevents the user from absent mindedly leaving a container filled with a combustible liquid in an unsafe location.

The present disclosure includes that contained in the appended claims, as well as that of the foregoing description. Although this invention has been described in its preferred form with a certain degree of particularity, it should be understood that the present disclosure of the. preferred form has been made only by way of example and that numerous changes in the details of construction and the combination and arrangement of parts may be resorted to without departing from the spirit and scope of the invention.

Now that the invention has been described,

What is claimed is:

1. A liquid containing apparatus for dispensing a liquid, said liquid containing apparatus hangable from a vertical support such that said liquid containing apparatus has a vertical height relative to the ground, said liquid containing apparatus comprising, in combination:

a container adapted to hold the liquid, thereby defining a liquid level within said container, said container comprising a plurality of flexible side walls and an outlet, one of said plurality of flexible side walls having a generally planar surface with an upper end, said upper end being horizontally supported by the vertical support such that said planar surface lies generally flat against said vertical surface when supported thereby, said outlet having a vertical height relative to said liquid level;

hanging means for hanging and supporting said container in an elevated position, said hanging means formed at said upper end of said one of said flexible side walls having said generally planar surface of said container and configured such that an opening is formed therethrough;

an elongated nozzle assembly with a flow control valve positioned therein, said nozzle assembly in liquid communication with said outlet of said container for dispensing the liquid therefrom; and a vent positioned in said container, said vent having a vertical height relative to said liquid level sufficient to provide a predetermined flow of liquid through said nozzle assembly.

2. The liquid containing apparatus as claimed in claim 1, wherein said container is a ten gallon container.

3. The liquid containing apparatus as claimed in claim 1, further comprising a hook for receiving said hanging means, said hook passing through said opening and said container being supported thereon.

4. The liquid containing apparatus as claimed in claim 1, further comprising gasoline contained within said container.

5. The liquid containing apparatus as claimed in claim 1, wherein said nozzle assembly further comprises a hose and a nozzle, said flow control valve being positioned within said nozzle, said flow control valve having both open and closed positions for controlling the liquid flow through said nozzle, said nozzle in fluid communication with a first end of said hose, and said hose in fluid communication with said outlet of said container and having a second end positioned in said container below said liquid level.

6. The liquid containing apparatus as claimed in claim 1, wherein said container further comprises a liquid intake port positioned in a top of said container, said liquid intake port being in fluid communication with the liquid in said container.

7. The liquid containing apparatus as claimed in claim 6, wherein said liquid intake port is capped by a one-way airflow cap coupled to said liquid intake port, said one-way airflow cap allowing air to flow into said container.

8. The liquid containing apparatus as claimed in claim 1, wherein said plurality of flexible side walls are disposed in a spaced relation to one another and extend upward from a base to a top of said container, one of said flexible side walls forming a front wall and another of said flexible side walls forming a rear wall oppositely disposed from said front wall at said base of said container, said front and rear walls extending upward to form said hanger means above said top of said container.

9. The liquid containing apparatus as claimed in claim 8, wherein said front and rear walls of said plurality of flexible side walls have a transverse dimension substantially greater than the transverse dimension of the other of said plurality of flexible side walls.

10. A liquid containing apparatus for dispensing a liquid, said liquid containing apparatus hangable from a vertical support such that said liquid containing apparatus has a vertical height relative to the ground, said liquid containing apparatus comprising, in combination:

a container adapted to hold the liquid, thereby defining a liquid level within said container, said container comprising a plurality of flexible side walls and an outlet, said outlet having a vertical height relative to said liquid level, said plurality of flexible side walls disposed in a spaced relation to one another and extend upward from a base to a top of said container, one of said flexible side walls forming a front wall and another of said flexible side walls forming a rear wall oppositely disposed from said front wall at said base of said container, said rear wall having a generally planar surface with an upper end, said upper end being horizontally supported by the vertical support such that said planar surface lies generally flat against said vertical surface when supported thereby, and said front and rear walls of said plurality of flexible side walls have a transverse dimension substantially greater than the transverse dimension of the other of said plurality of flexible side walls;

hanging means for hanging and supporting said container in an elevated position, said hanging means integrally formed at said upper end of said rear wall from said front wall extending upward and then rearwardly to form said hanger means at said upper end of said rear wall and configured such that an opening is formed therethrough;

a hook for receiving said hanging means, said hook passing through said opening and said container being supported thereon;

an elongated nozzle assembly with a flow control valve therein, said nozzle assembly in liquid communication with said outlet of said container for dispensing the liquid therefrom, said nozzle assembly comprising a hose and a nozzle, said flow control valve being positioned within said nozzle, said flow control valve having both open and closed positions for controlling liquid flow through said nozzle, said nozzle in fluid communication with a first end of said hose and said hose in fluid communication with said outlet of said container and having a second end positioned in said container below said liquid level; and a vent positioned in said container, said vent having a vertical height relative to said liquid level sufficient to provide a predetermined flow of liquid through said nozzle assembly.

11. The liquid containing apparatus as claimed in claim 10, further comprising gasoline contained within said container.

12. The liquid containing apparatus as claimed in claim 10, wherein said container further comprises a liquid intake port positioned in said top, said liquid intake port being in fluid communication with the liquid in said container.

13. The liquid containing apparatus as claimed in claim 10, wherein a filter is coupled to said second end of said hose.

* * * * *